US006341712B1

(12) United States Patent
Huang

(10) Patent No.: US 6,341,712 B1
(45) Date of Patent: Jan. 29, 2002

(54) MULTI-LAYER CONTAINER

(76) Inventor: Ja-Ling Huang, No. 185, Kaian Rd., Tainan City (TW)

( * ) Notice: Subject to any disclaimer, the term of this patent is extended or adjusted under 35 U.S.C. 154(b) by 0 days.

(21) Appl. No.: 09/516,226

(22) Filed: Mar. 1, 2000

(51) Int. Cl.[7] ..... B65D 1/40

(52) U.S. Cl. ..... 220/663; 220/62.14; 220/62.22; 220/602; 264/262

(58) Field of Search ..... 220/663, 662, 220/665, 62.22, 602, 62.14; 264/262

(56) References Cited

U.S. PATENT DOCUMENTS

| | | | | | |
|---|---|---|---|---|---|
| 746,645 | A | * | 12/1903 | Robin | 220/602 |
| 2,172,864 | A | * | 9/1939 | Calva et al. | 220/663 |
| 4,592,886 | A | * | 6/1986 | Mannherz | 264/262 |
| 5,275,277 | A | * | 1/1994 | Gallegos | 220/663 |
| 5,464,107 | A | * | 11/1995 | Koeinger | 220/662 |

FOREIGN PATENT DOCUMENTS

| | | | | |
|---|---|---|---|---|
| FR | 1140168 | * | 7/1957 | 220/663 |
| GB | 2269153 | * | 2/1994 | 220/662 |

* cited by examiner

*Primary Examiner*—Stephen P. Garbe
*Assistant Examiner*—Joseph C. Merck

(57) ABSTRACT

A multi-layer container having an outer container shell, an inner container shell mounted within the outer container shell, and a transparent intermediate bonding layer filled up the space defined between the outer container shell and the inner container shell and peripheral through holes on the inner container shell and a bottom through hole and peripheral through holes on the outer container shell, the outer container shell and the inner container shell showing a contrast in color.

1 Claim, 6 Drawing Sheets

MULTI-LAYER CONTAINER

BACKGROUND OF THE INVENTION

The present invention relates to a container, and more particularly to a multi-layer container, which is formed of multiple layers of different colors that isolate transmission of heat.

A regular container, as shown in FIG. 1 has a solid container wall 100. When holding a hot liquid, heat quickly directly transmitted through the container wall 100 to the user's hand, causing the user's hand to be scalded. Further, the structure of container cannot keep a hot liquid warm for long. FIG. 2 shows another structure of container according to the prior art. The container wall of this structure of container has two layers, namely, the inner layer 200 and the outer layer 201. The outer layer 201 is directly bonded to the inner layer 200. The fabrication process of this double-layer container is complicated, and its cost is high. When bearing an impact, the connection between the inner layer 200 and the outer layer 201 may be destroyed, causing a separation of the outer layer 201 from the inner layer 200.

SUMMARY OF THE INVENTION

The present invention has been accomplished to provide a multi-layer container, which eliminates the aforesaid drawbacks. According to one aspect of the present invention, the multi-layer container comprises an outer container shell, an inner container shell mounted within the outer container shell, and a transparent intermediate bonding layer filled up the space defined between the outer container shell and the inner container shell and peripheral through holes on the inner container shell and a bottom through hole and peripheral through holes on the outer container shell. According to another aspect of the present invention, the outer container shell and the inner container shell have different colors, showing a contrast. According to another aspect of the present invention, the transparent intermediate bonding layer prevents quick dissipation of heat from the inner container shell to the outer container shell. Because molding makes the multi-layer container, the manufacturing cost of the multi-layer container can be greatly reduced through a mass production. Further, because the transparent intermediate bonding layer has a part engaged into the peripheral through holes on the inner container shell and the peripheral through holes and bottom through hole on the outer container shell, the outer container shell and the inner container shell are fixedly secured together against impact.

DETAILED DESCRIPTION OF THE PREFERRED EMBODIMENT

Figure 2:
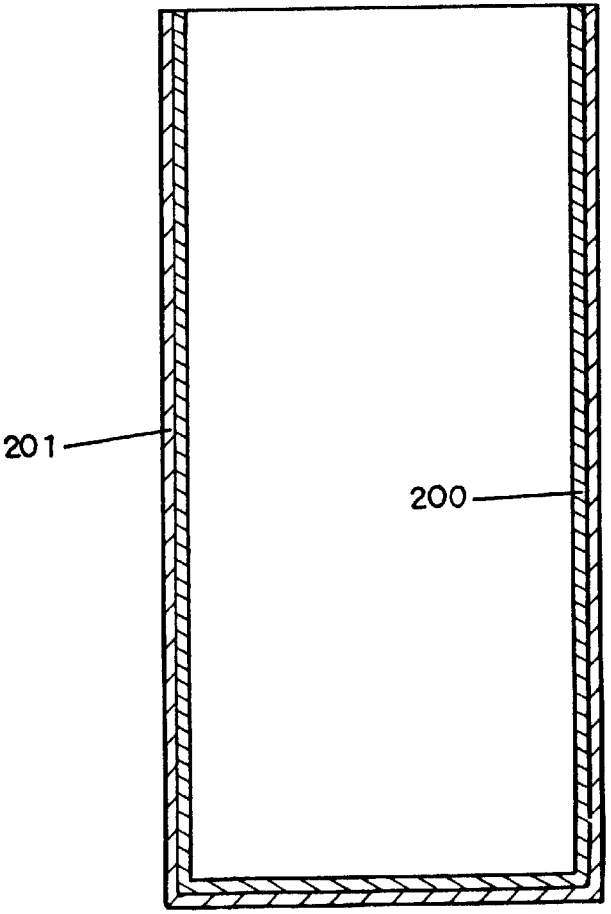
Fig.2(Prior Art)
FIG. 2 illustrates a double-layer container according to the prior art.
Figure 1:
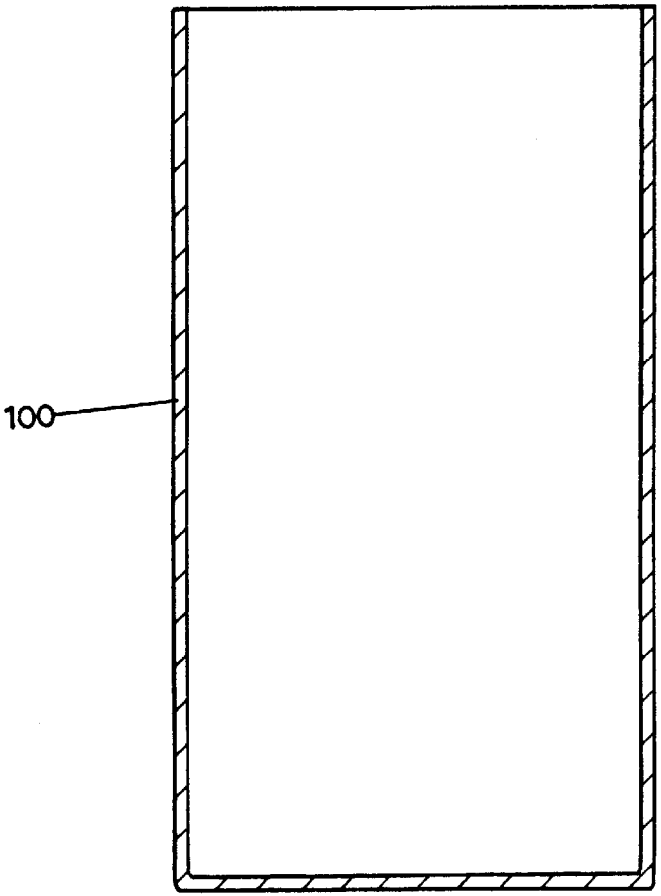
Fig.1(Prior Art)
FIG. 1 illustrates a single layer container according to the prior art.
Figure 3:
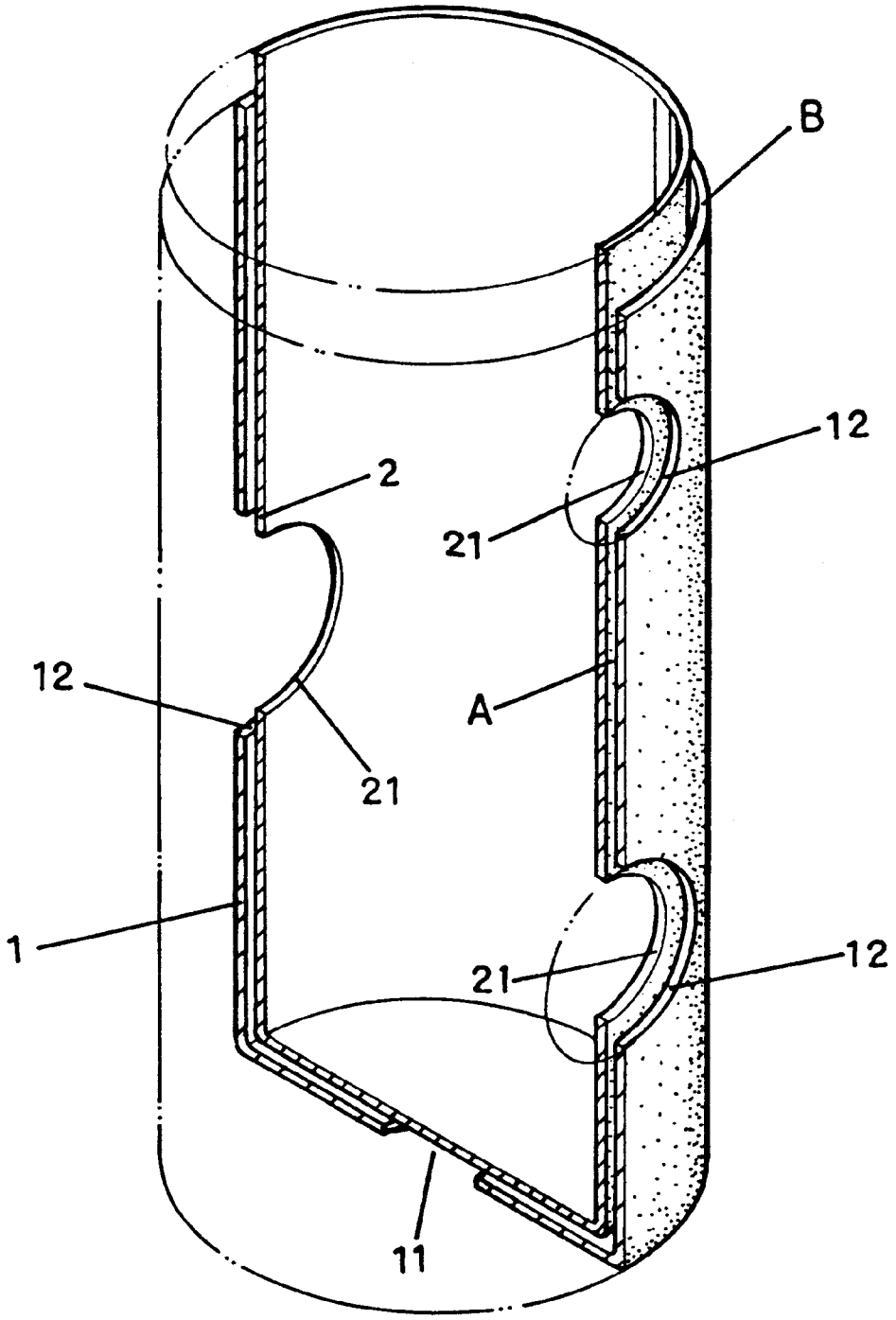
FIG. 3 is a perspective view of a part of the present invention, showing the cup-like inner container shell inserted into he cup-like outer container shell.
Figure 4:
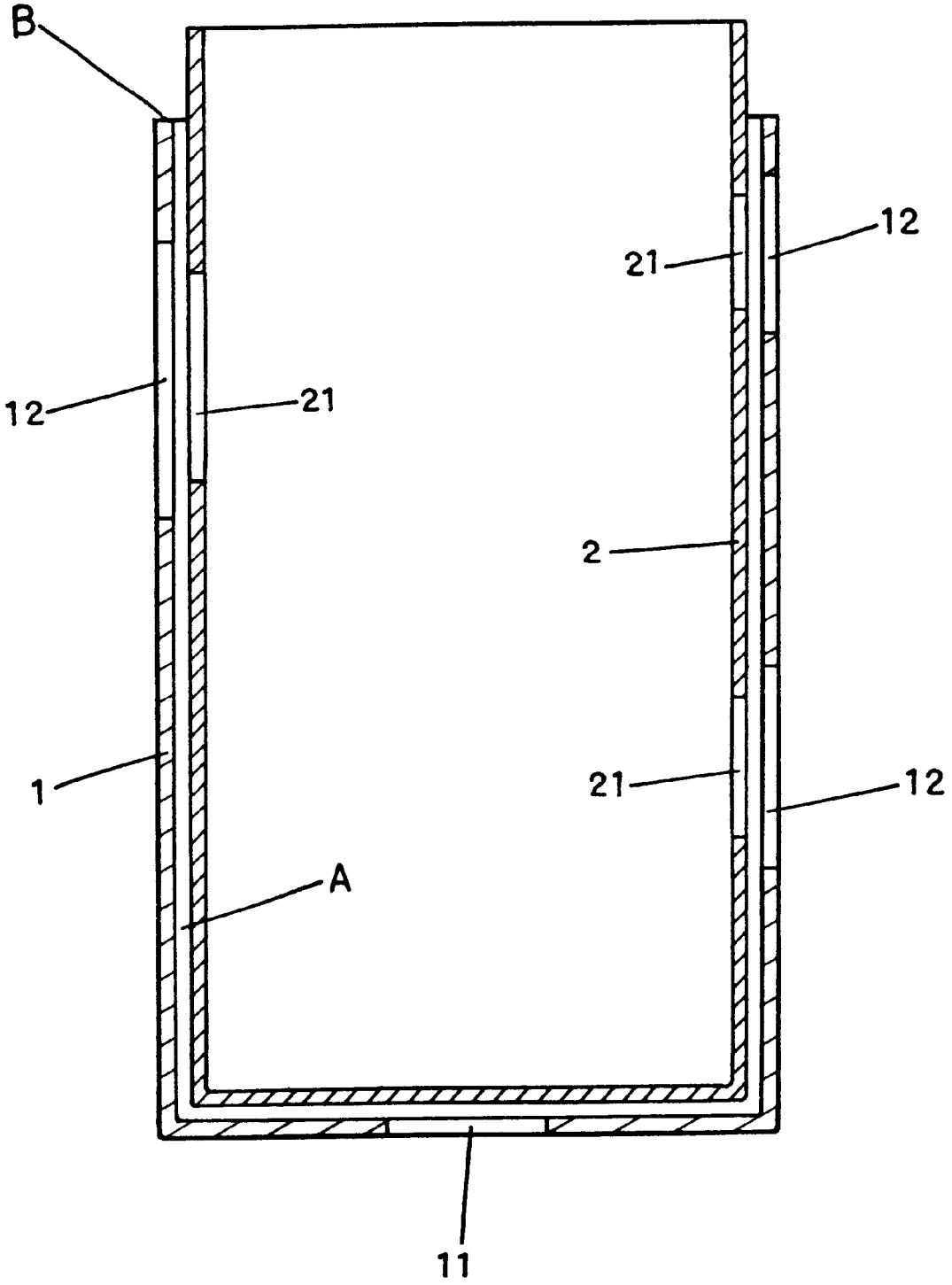
FIG. 4 is a sectional view of FIG. 3.
Figure 5:
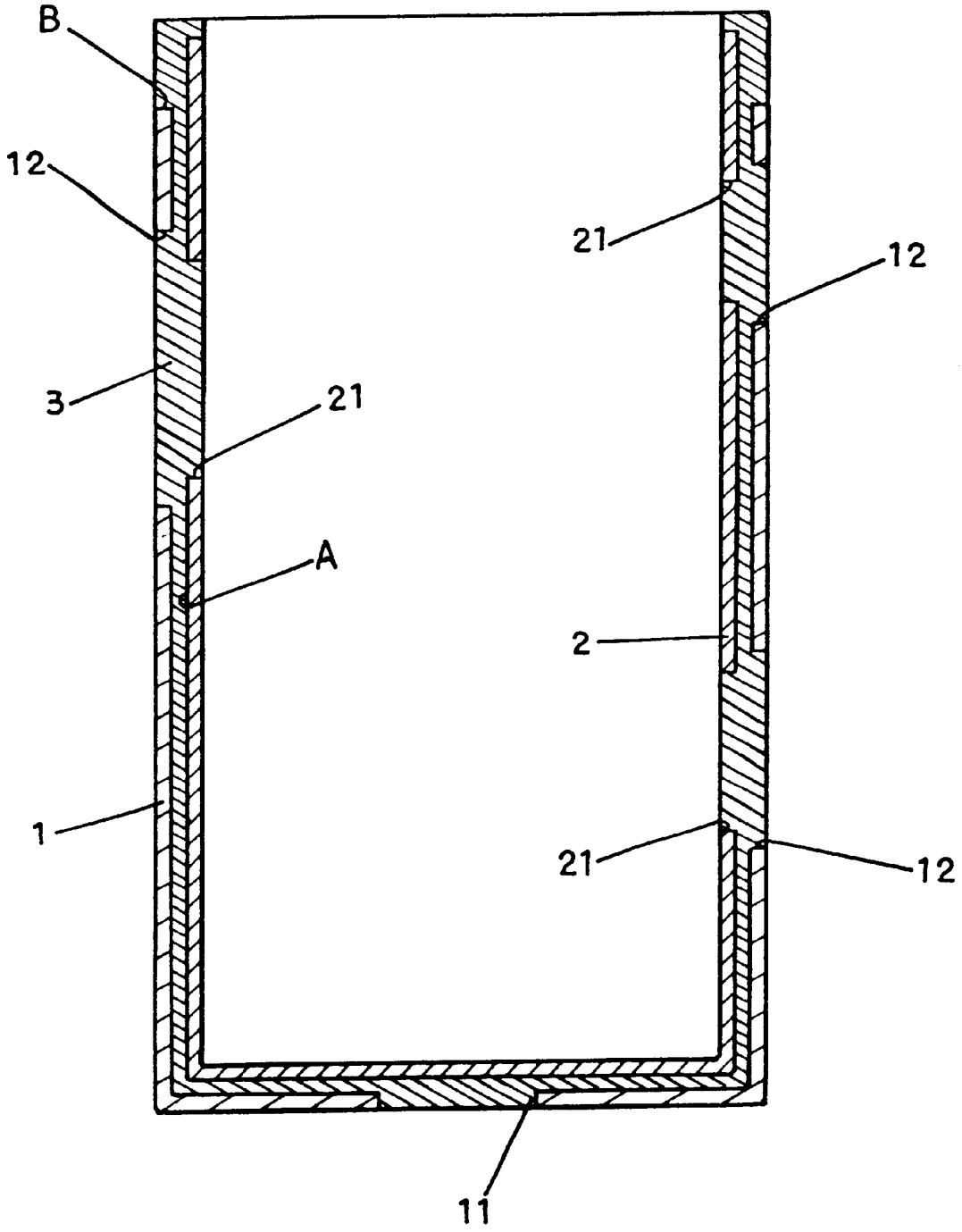
FIG. 5 is a sectional view of the present invention, showing he transparent intermediate bonding layer filled up the space between the outer container shell and the inner container shell and peripheral through holes on the inner container shell and a bottom through hole and peripheral through holes on the outer container shell.
Figure 6:
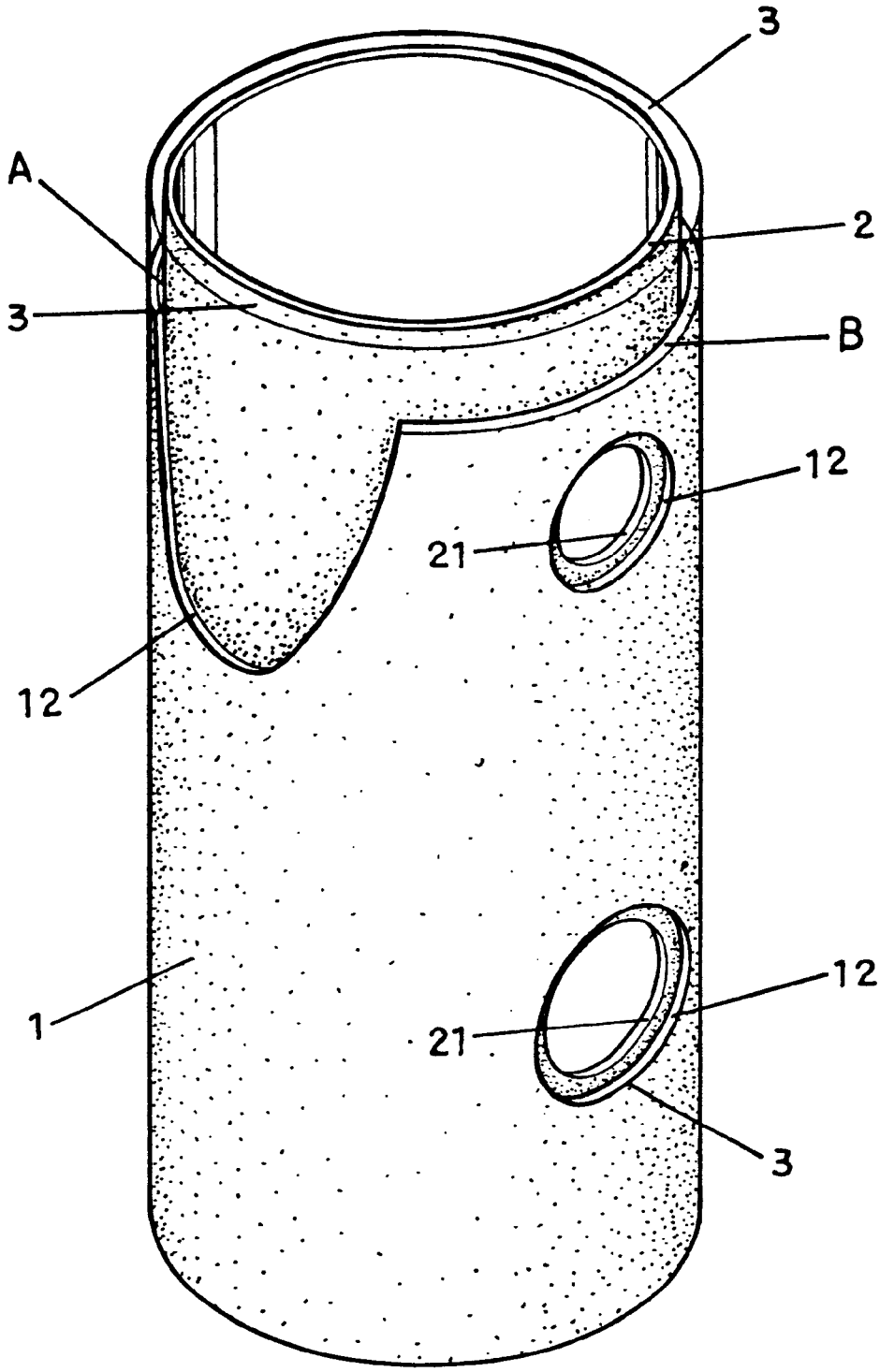
FIG. 6 is a cutaway view of the present invention.

Referring to FIGS. from 1 through 6, a multi-layer container in accordance with the present invention comprises a cup-like outer container shell 1, a cup-like inner container shell 2, and a transparent intermediate bonding layer 3. The diameter of the cup-like inner container shell 2 is smaller than the cup-like outer container shell 1. The cup-like outer container shell 1 has a bottom through hole 11, and a plurality of peripheral through holes 12. The cup-like inner container shell 2 has a plurality of peripheral through holes 21 respectively aimed at the peripheral through holes 12 on the cup-like outer container shell 1. The peripheral through holes 21 on the cup-like inner container shell 2 have a diameter relatively smaller than the peripheral through holes 12 on the cup-like outer container shell 1. The cup-like inner container shell 2 is taller than the cup-like outer container shell 1, and inserted into the cup-like outer container shell 1. After insertion of the cup-like inner container shell 2 into the cup-like outer container shell 1, a space A is defined between the inside wall of the cup-like outer container shell 1 and the outside wall of the cup-like inner container shell 2, and an elevation difference B is defined between the topmost edge of the cup-like outer container shell 1 and the topmost edge of the cup-like inner container shell 2 (see FIGS. 3 and 4), and then a transparent molten plastic material is filled into the space A to filled up the peripheral through holes 21 on the cup-like inner container shell 2 and the peripheral through holes 12 and bottom through hole 11 on the cup-like outer container shell 1 and to form the transparent intermediate bonding layer 3 (see FIG. 5), and a multi-layer container is thus obtained (see FIG. 6).

The cup-like inner container shell 2 and the cup-like outer container shell 1 have different colors that show a contrast. Because the transparent intermediate layer has a part engaged into the peripheral through holes 21 on the cup-like inner container shell 2 and the peripheral through holes 12 and bottom through hole 11 on the cup-like outer container shell 1, the cup-like inner container shell 2 and the cup-like outer container shell 1 are fixedly secured together against impact. Further, when the multi-layer container holds a hot liquid, the transparent intermediate bonding layer 3 prevents quick transmission of heat from the cup-like inner container shell 2 to the cup-like outer container shell 1.

Figure 7:
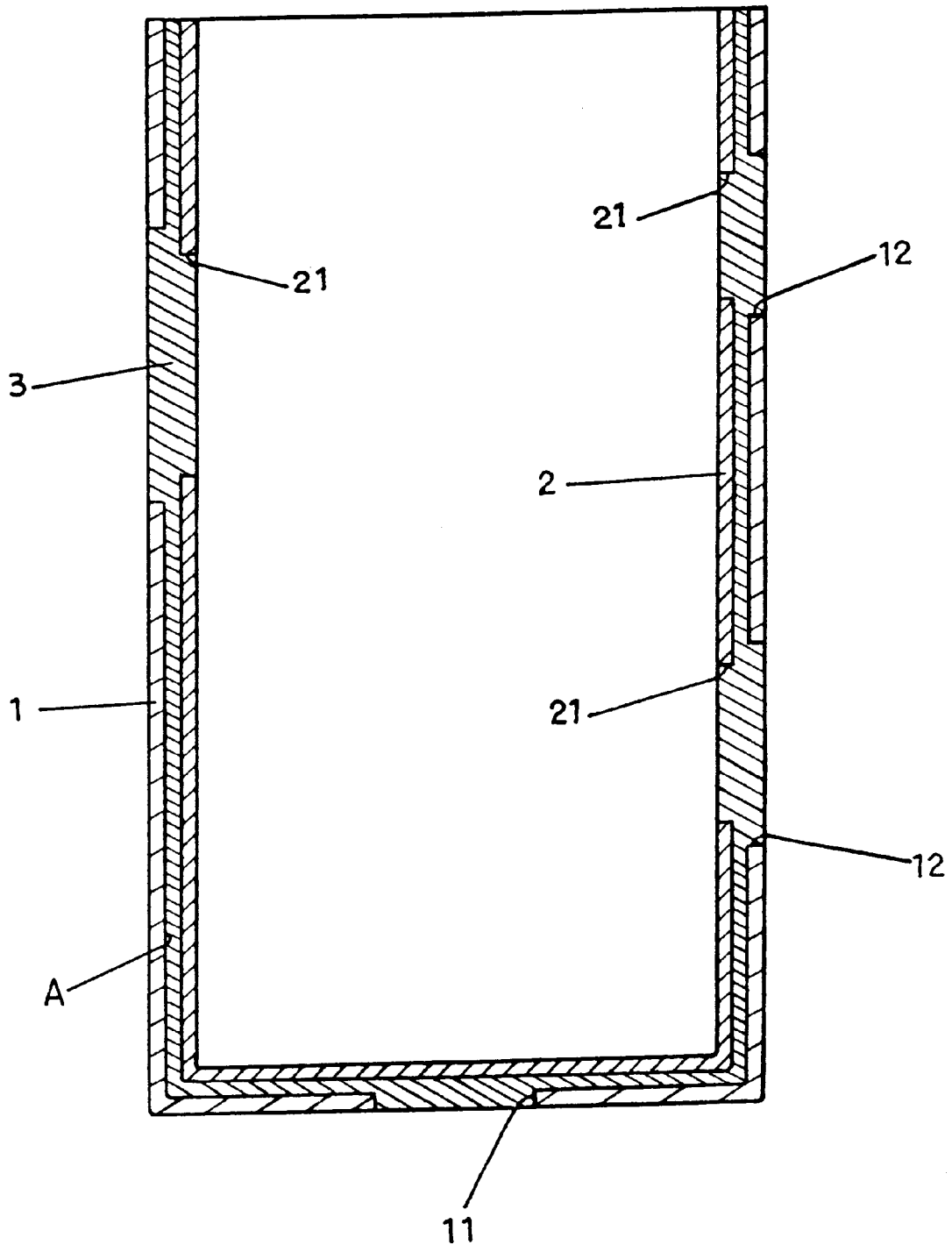
FIG. 7 is a sectional view of an alternate form of the multi-layer container according to the present invention.

FIG. 7 shows an alternate form of the present invention. According to this alternate form, the cup-like inner container shell 2 and the cup-like outer container shell 1 have same height.

It is to be understood that the drawings are designed for purposes of illustration only, and are not intended for use as a definition of the limits and scope of the invention disclosed. For example, the multi-layer container can be a bathtub, garbage-can, etc.

What the invention claimed is:

1. A multi-layer container, comprising:

a cup-like outer container shell, being provided with a plurality of first peripheral through holes and a bottom through hole;

a cup-like inner container shell, being disposed inside the outer container shell, and being provided with a plurality of second peripheral through holes; and a transparent intermediate bonding layer, being sandwiched between the outer container shell and the inner container shell;

characterized in that the second through holes are smaller than the first through holes and align with the first through holes respectively, and an annular space is arranged between the outer container shell and the inner container shell such that the intermediate bonding layer fills up the space, the first peripheral through holes, the second peripheral through holes and the bottom hole respectively;

whereby, the outer container shell, the inner container shell and the intermediate bonding layer can fixedly engage with one another, and the heat is unable to transmit to the outer container shell quickly from the inner container shell as soon as the hot liquid is received in the inner container shell.

* * * * *